US005509869A

United States Patent [19]

Miller

[11] Patent Number: 5,509,869

[45] Date of Patent: Apr. 23, 1996

[54] ISOTONIC CERVICAL EXERCISE DEVICE

[76] Inventor: Bruce W. Miller, P.O. Box 20267, Tampa, Fla. 33622

[21] Appl. No.: 398,575

[22] Filed: Mar. 3, 1995

Related U.S. Application Data

[63] Continuation-in-part of Ser. No. 208,991, Mar. 10, 1994, abandoned, which is a continuation-in-part of Ser. No. 134,800, Oct. 12, 1993, Pat. No. 5,336,139, which is a continuation-in-part of Ser. No. 29,874, Mar. 11, 1993, abandoned.

[51] Int. Cl.[6] ..... A63B 23/025

[52] U.S. Cl. ..... 482/10; 482/43; 482/124; 482/120; 482/127

[58] Field of Search ..... 482/10, 43, 124, 482/127, 120; 602/17, 18, 19

[56] References Cited

U.S. PATENT DOCUMENTS

| | | |
|---|---|---|
| 198,871 | 1/1878 | Case . |
| 1,618,273 | 2/1927 | Davidson . |
| 1,663,641 | 3/1928 | Smallwood . |
| 2,613,932 | 10/1952 | Manners . |
| 2,625,202 | 1/1953 | Richardson et al. . |
| 2,855,202 | 10/1958 | Kinne . |
| 3,336,922 | 8/1967 | Taylor . |
| 3,957,040 | 5/1976 | Calabrese . |
| 4,065,814 | 1/1978 | Fox . |
| 4,188,966 | 2/1980 | Palmer et al. . |
| 4,352,352 | 10/1982 | Janovsky et al. . |
| 4,606,542 | 8/1986 | Segal . |
| 4,645,198 | 2/1987 | Levenston . |
| 4,698,847 | 10/1987 | Yoshihara . |
| 4,955,608 | 9/1990 | Dougherty et al. . |
| 5,046,194 | 9/1991 | Alaniz et al. . |
| 5,062,642 | 11/1991 | Berry et al. . |
| 5,109,546 | 5/1992 | Dicker . |
| 5,186,701 | 2/1993 | Wilkinson . |
| 5,201,074 | 4/1993 | Dicker . |

FOREIGN PATENT DOCUMENTS

| | | |
|---|---|---|
| 480383 | 5/1916 | France . |
| 2269977 | 5/1975 | France . |
| 564863 | 8/1977 | U.S.S.R. . |
| 1639-674A | 7/1991 | U.S.S.R. . |
| 1048148 | 11/1966 | United Kingdom . |

*Primary Examiner*—Lynne A. Reichard
*Attorney, Agent, or Firm*—Arnold White & Durkee

[57] ABSTRACT

An apparatus for exercising the muscles surrounding the cervical spine of a person, comprising: a belt adapted to be secured about the waist of a person, and including frontal and posterior portions; a pair of suspenders connecting at their frontal ends of opposing frontal portions of the belt, extending over opposing shoulders of the person, and connecting at their posterior ends to opposing posterior portions of the belt; a chin cup adapted to fit around the person's chin; a head band adapted to fit around the person's head and including frontal and posterior portions; a first elastic strap adapted to provide a tensile load between the chin cup and the frontal portion of the belt; and a plurality of elastic straps adapted to provide tensile loads between the frontal portion of the head band, across the person's head, and the posterior portion of the belt or suspenders.

32 Claims, 3 Drawing Sheets

ISOTONIC CERVICAL EXERCISE DEVICE

This application is a continuation-in-part of patent application Ser. No. 08/208,991 filed Mar. 10, 1994 now abandoned which is a continuation-in-part of patent application Ser. No. 08/134,800 filed Oct. 12, 1993 now U.S. Pat. No. which is a continuation-in-part of patent application Ser. No. 08/029,874 filed Mar. 11, 1993 and now abandoned.

BACKGROUND OF THE INVENTION

1. Field of the Invention

The subject invention relates generally to rehabilitation devices for the musculature of the cervical spine and, more particularly, to medical devices designed to strengthen, support and rehabilitate neck muscles and ligaments surrounding the cervical spine. The device of this invention is a functional assemblage of components arranged to universally fit patients or other users. The individual components can be assembled from multiple components.

2. Description of the Prior Art

A variety of exercise and medical devices have been used in the past to exercise or rehabilitate the neck or spine of individuals recuperating from accidents, e.g., automobile or athletic. The prior art devices can generally be characterized as cumbersome, unattractive and ineffective. The use of such devices has been hampered by the requirement that movement and activity is extremely limited while such devices are worn.

The isotonic device of this invention solves these prior art problems by providing a device that is worn during normal activity and that achieves its therapeutic benefits during such routine use. The term 'isotonic', as used herein, means that the forces placed on the muscles and ligaments in the cervical area are substantially the same when the head is moved in any direction; i.e., flexion, extension, left and right lateral flexion, and left and right rotation. The device of this invention has utility primarily as a rehabilitation device but also as an exercise device for the isotonic treatment of the neck and cervical spine area. The device of this invention simultaneously provides exercise, support, and recuperative ability.

One of the devices of the prior art for exercising the human neck involves the use of a series of straps of cloth material which are sewn or otherwise secured together to form a hat-like pocket for cradling the head of the person whose neck is to be exercised. Portions of the strap are arranged to depend from the hat portion of this prior art device so as to extend substantially below the neck and shoulders of the person performing a neck exercise routine but not, typically, below the waist of such user. The ends of such straps terminate in loops for anchoring suitable weighted objects thereto.

The use of this prior art neck exercising device involves placing the hat portion over the head of the person whose neck is to be exercised, affixing one or more weighted objects to the looped portions of the depending straps, and thereafter moving the neck up and down and side to side. The weighted objects provide a constant pull or "force" which is transmitted to the user's neck via the depending straps and the hat structure formed by the sewn straps. The neck is thereby exercised along with the muscles of the human body which are associated with the movement of the human neck. At least one deficiency with this prior art device lies in the inability of the user to comfortably stand up and exercise his neck. The contact of the weighted objects with the user's body is in some cases intolerable and in other cases, simply a nuisance and source of irritation.

Another prior art neck exercising device includes an upright frame capable of surrounding the upper torso of a person. This device includes: a pair of handles for the manual gripping of the frame, a plurality of weighted objects, and some flexible ropes. One end of each rope is secured to one of the weighted objects. The device further includes guide means secured to a frame for guiding each of the plurality of ropes; means for securing the ropes to the weighted objects; and means for securing the unattached ends of the ropes to the head of the person using the device.

The use of this prior art device relies on movements of the weights which are intended to strengthen the neck. This device, however, can present problems when used by patients with a herniated disc since such weights can cause additional compression of the cervical spine and therefore, possibly exacerbate the injuries of the cervical spine. In addition, the use of the frame is cumbersome and a nuisance.

In the prior art there are also total body exercising mechanisms which include means for exercising the neck muscles along with other muscles of the body. Generally these devices include a headpiece connected to either a chest piece or a back piece by an elastic strap to provide some resistance to the movement of the head during the exercising. Such devices do not provide for the isotonic treatment of the musculature of the cervical spine and should not be used for the rehabilitation of the cervical spine as they do not place the desired multiple and symmetrical forces to the cervical area.

At the present time, there is a continuing need for a device for exercising the cervical spine as it relates to the rehabilitation of injuries to the cervical spine, deformities of the cervical spine and disease of the spine affecting the neck area. There is also a need for strengthening soft tissues and ligamentous tissue, such as the anterior, posterior and left and right lateral longitudinal ligaments of the cervical spine. A device is especially needed when these areas have been exposed to trauma and injury has resulted and for the post-surgical rehabilitation of soft tissue after cervical laminectomies. A device is also needed for those people suffering from a weakness in the cervical spine from other causes other than trauma. Especially needed is a device which can address the above needs while depending solely on isotonic responses (without weights) to natural movements, and allows the person to use the device while engaging in almost any type of activity.

SUMMARY OF THE INVENTION

In its broadest aspect the present invention is a medical device for rehabilitating the cervical spine of a person by the isotonic exercising of the muscles surrounding the cervical spine. The broadest embodiment of the medical device of this invention comprises an assemblage of elements including a cranial support means, front and back tension control means connected to each other, and at least four tensioning means functionally interconnecting the cranial support means to the front and back tension control means to form such medical device. Preferably the cranial support means encircles the head of the user and has a front portion, a back portion, and a pair of opposed side portions. The first of the tensioning means connects the front portion of the cranial support means to the front tension control means. The second of said tensioning means connects the back portion of the cranial support means to the back tension control means. The third and fourth tensioning means connect the cranial support means to the tension control means and are disposed equidistant from and on opposite sides of the second tensioning means. Preferably the tensioning means comprise one or more elastic straps. A preferred embodiment of the present invention includes a plurality of positioning straps connecting the front and back tension control means and a lumbar belt connected to the front and back tension control means. Optionally a chin cup is interconnected to the tension control means. By adjusting the tension in the tensioning means, such as adjusting the length of the elastic straps, interconnecting the cranial support means to the front and back tension control means, the effective force on the cervical spine area is changed so that the desired isotonic treatment is achieved.

One preferred embodiment of the present invention comprises a breast plate; a back plate; a headband adapted to fit around a person's head; a belt adapted to fit around a person's lower torso and connected to the breast and back plates; a lumbar belt adapted to fit around a person's waist and connected to the breast and back plates; a pair of straps wherein one strap extends over a person's left shoulder and connects the respective left upper portions of the breast and back plates and another strap which extends over a person's right shoulder and connects the respective right portions of the breast and back plates; and a plurality of elastic straps adapted to provide loads between the headband and the breast and back plates.

DETAILED DESCRIPTION OF THE PREFERRED EMBODIMENTS

Figure 1:
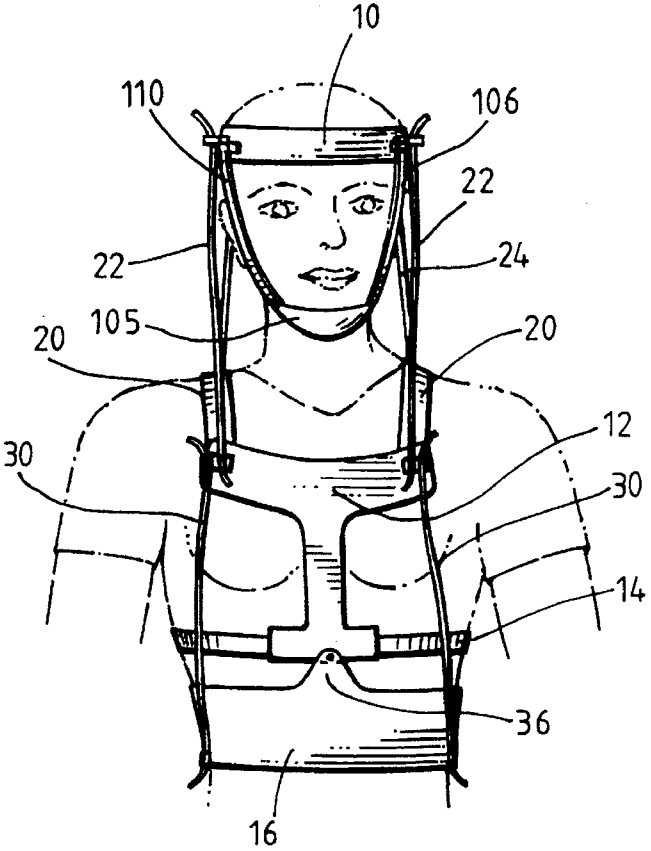
FIG. 1 is a front view of a person wearing an embodiment of the invention in a neutral position.

The present invention is an isotonic cervical rehabilitation device designed to create an isotonic movement of the cervical spine to strengthen the soft tissues, including ligamentous, muscle, and other soft tissue connections affecting the cervical spine.

In one embodiment, the medical device of the present invention includes a cranial support means, front and back tension control means including means connecting the front and back tension control means, tensioning means connecting the cranial support means to the front and back tension control means, a lumbar belt and straps connecting the lumbar belt to the front and back tension control means. The cranial support means is generally designated by the numeral 10 and is in the form of a head band. Other more rigid structures are likewise usable. The purpose of the cranial support means 10 is to provide the cranial attachment for the tensioning means connected to the portion of the device surrounding the upper torso of the user. Therefore, the cranial support means may take the form of any convenient head band or similar structure. It is necessary that the cranial support means have a plurality of connecting means for receiving one end of tensioning means (in this embodiment elastic straps) connecting the cranial support means to the lower portion of the device.

In one embodiment, the medical device of the present invention also includes front and back tension control means. The purpose of the tension control means is to provide attachment means on the user's body for the various elastic and positioning straps that are used to interconnect the components of the assembly of this invention. In one form, the front and back tension control means are hard plates with attachment sites for the elastic and inelastic straps. Front tension control means is generally designated by the number 12 and back tension control means is generally designated by the number 18. Both the front and back tension control means include receptive sites for elastic straps and inelastic positioning straps interconnecting with the cranial support means and the lumbar belt. In this embodiment, both the front and back tension control means are made from a hard plastic in a functionally effective shape to maintain the position of the portion of the device strapped to the upper torso in comparison to the movement of the cranial support means engaged by the head of the user. Other forms and other materials are equally applicable to the front and back tension control means. In a preferred embodiment, the front tension control means takes the form of a breast plate made of a hard plastic material with a cushioning material on the inside. Likewise, the back tension control means is made of a hard plastic material with a cushioning material likewise included.

A third component of the device in this embodiment of the present invention is the lumbar belt 16. The lumbar belt takes the form of what are generally referred to as back support belts typically worn by workers whose duties include lifting materials. The lumbar belts are typically four to ten inches in width and are made of leather or a synthetic material. The lumbar belts are structurally rigid to provide a firm anchor for the front and back tension control means and the cranial support means. In many instances, the lumbar belt has a buckle engagement means or other engagement means. The size and shape of the belt can be custom designed to fit the particular user.

In connecting the cranial support means 10, front tension control means 12, back tension control means 18 and lumbar belt 16 are a series of elastic straps and positioning straps. These straps may take the form of elasticized tubing or flat elasticized cloth material or any other convenient form. The first set of elastic straps connects the cranial support means to the front and back tension control means. These straps are generally identified by the numerals 22, 24, 26, and 28. A plurality of straps are necessary to connect the cranial support means to the front and back tension control means in order to provide isotonic tension for both front and back movement of the cranial area. Additional elastic straps are likewise preferred to provide isotonic tension for whatever direction the cranial area is moved. As mentioned previously, in one embodiment of the invention, these elastic straps take the form of rubberized tubing. However, this is not meant by way of limitation but merely by way of example. Other elasticized material or tensioning devices; such as, springs or the like, may be used depending on the desired configuration and appearance of the final device.

Similarly, elastic straps 32 are used to connect the lumbar belt to the front and back tension control means. This interconnection provides additional tension and isotonic exercise to the cranial and cervical areas. The elastic straps are similar to those used to connect the front and back tension control means to the cranial support means. In each instance, it is necessary that the elastic strap be adjustable to accommodate different sizes of users and different desired tensions.

Positioning straps 36 are used to connect the front and back tension control means to the lumbar belt. These straps are not intended to be elastic although in certain embodiments they may be slightly elastic. The purpose of positioning straps 36 is to firmly anchor the front and back tension control means and to position said control means relatively firmly on the body of the user. In a preferred embodiment of this invention positioning straps 36 are inelastic and adjustable straps attachable to the lumbar belt 16.

In one embodiment of the present invention the device generally comprises; a breast plate; a back plate; a head band adapted to fit around a person's head; a belt adapted to fit around a person's lower torso and back; a lumbar belt adapted to fit around a person's waist; a pair of straps adapted to extend over a person's shoulders and connect the respective right and left sides of the upper portions of the breast plate and back plate; and a plurality of adjustable elastic straps adapted to provide tensile loads between the head band and the breast and back plates, and between the lumbar belt and the breast and back plates.

The device operates in an isotonic manner. Each of the elastic straps are adjustable so that when the device is placed on a person, each strap is tightened to the point of resistance. The point of resistance is the amount of tension that occurs just prior to the point where a pulling effect occurs. Thus, when the device is in operation, any movement caused by the person, such as anterior flexion, posterior extension, left and right lateral flexion or left and right rotation is affected by the restraint effect of the elastic straps, thereby accomplishing an isotonic type of resistance for building of the soft tissue surrounding the spine.

The device is unique because it requires only the movement of the cervical spine in a natural motion in order to achieve an isotonic response and thus strengthen the tissue surrounding the cervical spine. It achieves the foregoing result without the need for cumbersome weights. In addition, it does not depend on an isometric response, which is a force against an immovable source. Therefore, the device allows a person to engage in almost any type of activity while wearing (operating) the device, including, but not limited to, household activities and work activities, whether sitting, lying, standing or walking.

Figure 2:
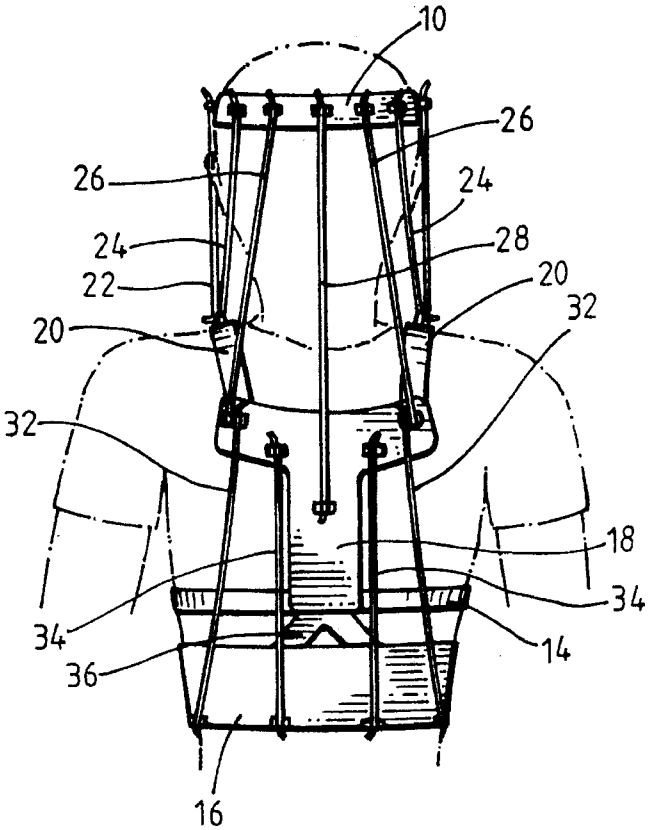
FIG. 2 is a posterior view of a person wearing the embodiment of the device of FIG. 1 in a neutral position.
Figure 3:
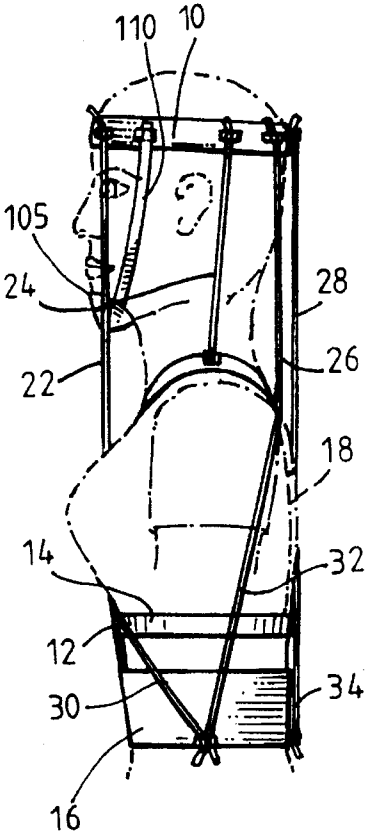
FIG. 3 is the corresponding side view of a person wearing the embodiment of the device of FIG. 1 in a neutral position.

Turning now to the drawings, FIG. 1 is a front view of a person wearing an embodiment of the isotonic cervical rehabilitation device in a neutral position. FIG. 2 is a posterior view of a person wearing the embodiment of the isotonic cervical device of FIG. 1 in a neutral position. FIG. 3 is a side view of a person wearing the embodiment of FIGS. 1 and 2 in a neutral position.

Referring to FIGS. 1, 2 and 3, a head band 10 is adapted to be secured around a person's head, and includes frontal, posterior and side portions corresponding to the respective areas of the person's head. A breast plate 12 is adapted to fit against the frontal side of a person's body. The breast plate 12 may further include a padding on one side of the breast plate 12 to act as a cushion between the breast plate 12 and the person's body. A belt 14 is adapted to fit around the person's lower torso and lower back. The belt 14 is coupled to the breast plate 12 and a back plate 18.

A lumbar belt 16 is adapted to fit around a person's waist or lower torso and is releasably coupled to the breast plate 12 and backplate 18. The lumbar belt 16 may provide back support to the person. In addition, the lumbar belt 16 acts as an anchoring mechanism for elastic straps. A back plate 18 is adapted to fit against the posterior portion of the person's body. More particularly, the back plate 18 is adapted to fit against a person's back and may further include a padding on one side to act as a cushion between the back plate 18 and the person's body.

A pair of straps 20 are adapted to hold the breast plate 12 and back plate 18 in position on the person's body. A first strap 20 is connected at one end to the upper left portion of the breast plate 12, extends over the person's left shoulder and is connected at the opposite end to the upper left portion of the back plate 18. A second strap 20 is connected at one end to the upper right portion of the breast plate 12, extends over the person's right shoulder, and is connected at the opposite end to the upper right portion of the back plate 18.

A plurality of adjustable elastic straps 22, 24, 26, and 28 are adapted to provide tensile loads between the head band 10 and breast plate 12, back plate 18 and straps 20. In this embodiment, a pair of adjustable elastic straps 22 provide tensile loads between the right and left frontal portions of the head band 10 and the right and left upper portions of the breast plate 12, respectively; a pair of adjustable elastic straps 24 are adapted to provide tensile loads between the right and left posterior portions of the head band 10 and the right and left straps 20, respectively; a pair of adjustable elastic straps 26 are adapted to provide tensile loads between the right and left posterior portions of the head band 10 and the right and left upper portions of the back plate 18, respectively; and an adjustable strap 28 is adapted to provide a tensile load between the middle posterior portion of the head band 10 and the middle portion of back plate 18.

Also, in this embodiment, a plurality of adjustable elastic straps 30, 32, and 34 are adapted to provide tensile loads between the breast plate 12 and the lumbar belt 16, and between the back plate 18 and the lumbar belt 16. More particularly, a pair of adjustable elastic straps 30 are adapted to provide tensile loads between the right and left upper portions of the breast plate 12 and the right and left portion of the lumbar belt 16, respectively. Additionally, a pair of adjustable elastic straps 32 are adapted to provide tensile loads between the upper right and left portions of back plate 18 and the right and left portions of the lumbar belt 16, respectively. Also in this embodiment, a pair of adjustable elastic straps 34 are adapted to provide tensile loads between right and left portions of back plate 18 and the right and left portions of lumbar belt 16, respectively.

An embodiment of this invention may include an optional chin cup 105 adapted to fit around a person's chin. The chin cup 105 may be held in place on the person's chin by one or more adjustable elastic straps 110 adapted to provide tensile loads between the right and left sides of the chin cup 105 and the head band 10. In addition, one or more adjustable elastic straps may be adapted to provide tensile loads between the chin cup 105 and the straps 20, breast plate 12, belt 14 and/or lumbar belt 16.

Referring to FIGS. 4, 5, 6 and 7 of the drawings there is depicted another embodiment of the cervical rehabilitation device of the present invention. The device comprises a cranial support means which in this embodiment is an inflatable head band 50. The inflatable head band 50 may be divided into a plurality of separate inflatable compartments so as to fit snugly about heads of various sizes and shapes.

The inflatable headband 50 is inflated using a hand pressure bulb 52 attached to the inflatable head band 50 with an appropriate hollow tube 54 as is well known in the art.

Figure 4:
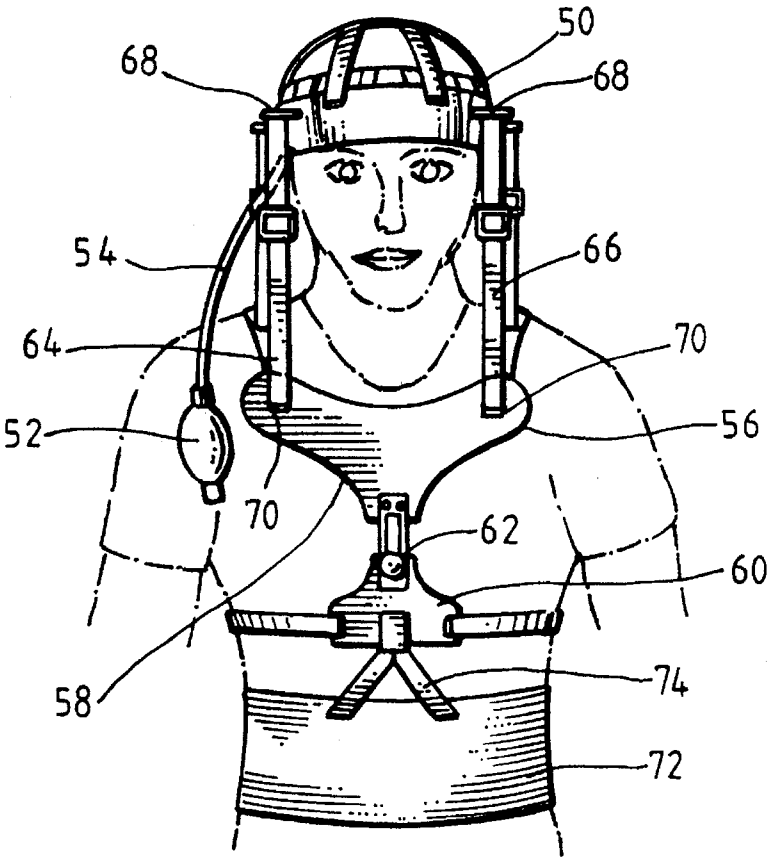
FIG. 4 is a front view of a person wearing another embodiment of a device of the present invention.
Figure 7:
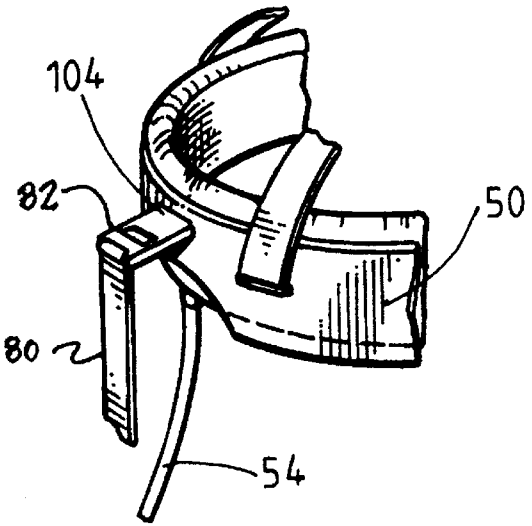
FIG. 7 is an enlarged side view of the inflatable head band of the embodiment depicted in FIGS. 4–6.

As seen in FIG. 4 the inflatable head band 50 is attached to a breast plate 56. The breast plate 56 comprises two sections, a top section 58 and a bottom section 60. The sections, 58 and 60, are connected by an adjustable means 62 which allows the sections, 58 and 60, to be positioned with regard to each other. This adjustability allows the device to be used by people of different heights. Shorter people will keep the sections, 58 and 60, close together while taller people will position the sections, 58 and 60, further apart. The breast plate 56 may have its inside surface padded for comfort reasons.

The inflatable head band 50 is connected to the breast plate 56 by a first tensioning means which in this embodiment is a pair of elastic straps 64 and 66. One end of each strap, 64 and 66, is attached to an extension 68 on the inflatable head band 50. The opposite end of each strap, 64 and 66, is adjustably attached to loops 70 in the upper portion of the breast plate 56. The straps, 64 and 66, are separated a distance to provide the wearer with suitable vision between the straps. As shown in FIG. 4, the extensions 68 on the inflatable head band 50 and the loops 70 in the upper portion of the breast plate 56 are in substantial alignment so that the straps, 64 and 66, are substantially parallel and vertical. Also it is preferred that the straps, 64 and 66, be positioned approximately equidistant on either side of the center of the wearer's face.

In the embodiment illustrated in FIGS. 4, 5, 6, and 7, a lumbar belt 72 is attached to the bottom portion 60 of the breast plate 56. The lumbar belt 72 is adjustably attached to the bottom portion 60 of the breast plate 56 with strap 74. This allows the belt 72 to be positioned a desired distance from the bottom portion 60 of the breast plate 56 as desired by the user. The lumbar belt 70 is also adjustable to fit various waist sizes as is well known in the art.

Figure 5:
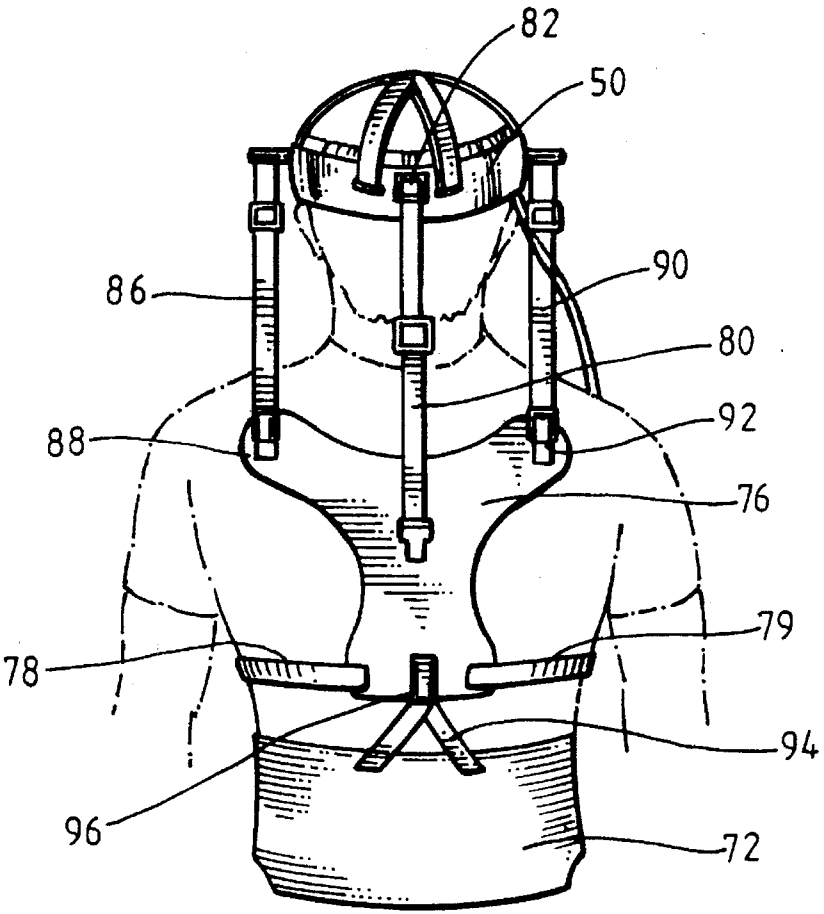
FIG. 5 is a back view of the embodiment depicted in FIG. 4.

FIG. 5 is a back or posterior view of the device depicted in FIG. 4. The device includes a back plate 76 as shown. The back plate 76 and breast plate 56 are connected by adjustable straps 78 and 79 to allow the device to be used by individuals of various size. The inflatable head band 50 is attached to the back plate 76 by a second tensioning means which in the embodiment shown is an adjustable elastic strap 80. One end of the strap 80 is connected to an extension 82 on the inflatable head band 50 and the opposite end of the strap 80 is adjustably connected to a loop 84 on the back plate 76. The elastic strap 80 is disposed in a substantially vertical position.

In the embodiment illustrated in FIGS. 4, 5, 6, and 7, a third tensioning means comprising an elastic strap 86 connects the inflatable head band 50 to the back plate 76. One end of the strap 86 is attached to an extension 87 on the inflatable head band 50 and the opposite end of the strap 86 is adjustably attached to a loop 88 on the back plate 76. A fourth tensioning means comprising an elastic strap 90 also connects the inflatable head band 50 to the back plate 76. One end of the strap 90 is attached to an extension 91 on the inflatable head band 50 and the opposite end of the strap 90 is adjustably attached to a loop 92 on the back plate 76. The third and fourth tensioning means are disposed on opposite sides of the second tensioning means and equidistant from the second tensioning means; i.e, elastic strap 80.

The lumbar belt 72 is attached to the back plate 76 by an adjustable strap 94 extending from the belt to a loop 96 on the back plate 76 and back to the lumbar belt 72.

Figure 6:
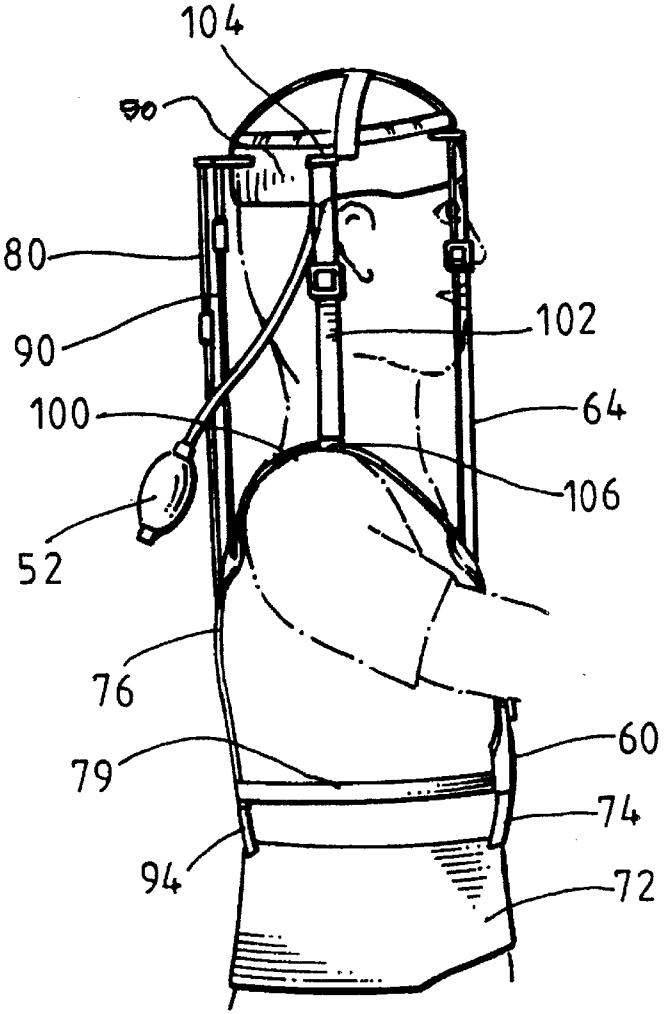
FIG. 6 is a side view of the embodiment depicted in FIGS. 4 and 5.

In this embodiment the tension control means includes a pair of straps. The straps connect the upper portion 58 of the breast plate 56 to the back plate 76. In FIG. 6 the right side of the wearer of the device is shown. A similar mechanism as hereinafter described for the right side of the wearer is disposed on the left side of the wearer (not illustrated). One strap 100 connects the right top edge of the back plate 76 to the right top edge of the breast plate 56 and is adapted to fit over the right shoulder of the wearer. A similar strap (not illustrated) connects the left top edge of the back plate 76 to the left top edge of the breast plate 56 and is adapted to fit over the left shoulder of the wearer.

In the embodiment illustrated in FIGS. 4, 5 and 6 an additional third tensioning means, elastic strap 102, connects the inflatable head band 50 to the right shoulder strap of the tension control means. One end of the strap 102 is attached to an extension 104 on the inflatable head band 50 and the opposite end of the strap 102 is adjustably attached to a loop 106 on the strap 100. An additional fourth tensioning means, elastic strap (not illustrated), connects the head band to the left shoulder strap of the tension control means in a similar manner. Both straps are adjustable in length. It is preferred that the additional third and fourth tensioning means be disposed on opposite sides of the second tensioning means; i.e. elastic strap 80, and equidistant therefrom.

By adjusting the tension on each of tensioning means, isotonic treatment of the musculature of the cervical spine may be accomplished as the wearer moves his head by bending it in a forward direction, extending it in a backward direction, extending or bending the head to either side or by rotating the head in any direction. Hence the present device provides for strengthening of the muscles in all six directions: flexion, extension, left and right lateral flexion, and left and right rotation.

The embodiment illustrated in FIGS. 4, 5, 6, and 7 may further include an optional chin cup 105 adapted to fit around a person's chin. The chin cup 105 may be held in place on the person's chin by one or more adjustable elastic straps 110 adapted to provide tensile loads between the right and left sides of the chin cup 105 and the inflatable head band 50. In addition, one or more adjustable elastic straps 110 may be adapted to provide tensile loads between the chin cup 105 and the straps 100, breast plate 56, straps 78 and 79 and/or the lumbar belt 72.

While specific embodiments of the invention have been shown by way of example in the drawings and described in the detailed description the invention is susceptible to various modifications and alternative forms. It should be understood that the invention is not intended to be limited to the particular forms disclosed. Rather, the invention is to cover all modifications, equivalents and alternatives which come within the spirit and scope of the invention as defined by the following claims.

What is claimed is:

1. A medical device for the rehabilitation of the cervical spine of a user comprising:

cranial support means adapted to removably engage a cranial area of said user, said cranial support means having a front, back, and two sides;

front and back tension control means connected to each other; and at least four tensioning means connecting said cranial support means to said front and back tension control means, a first of said tensioning means connecting said front of said cranial support means to said front tension control means, a second of said tensioning means connecting said back of said cranial support means to said back tension control means, and a third and a fourth of said tensioning means disposed approximately equidistant from said second tensioning means on opposite sides thereof and connecting said cranial support means to said front and back tension control means.

2. The medical device of claim 1, wherein said at least four tensioning means are elastic straps.

3. The medical device of claim 1, wherein said elastic straps are adjustable.

4. The medical device of claim 1, wherein said first of said tensioning means comprises a pair of spaced apart elastic straps connecting said cranial support means to said front tension control means.

5. The medical device of claim 1, wherein said third of said tensioning means comprises a pair of elastic straps connecting said cranial support means to said front and back tension control means and said fourth of said tensioning means comprises a pair of elastic straps connecting said cranial support means to said front and back tension control means.

6. The medical device of claim 1, further comprising a lumbar belt attached to said front and back tension control means.

7. The medical device of claim 1, wherein said cranial support means comprises an inflatable head band and said device further comprises means for inflating said inflatable head band.

8. The medical device of claim 1, wherein said front and back tension control means are connected to each other by a plurality of positioning straps.

9. A medical device for the rehabilitation of the cervical spine of a user comprising:

(a) cranial support means adapted to removably engage a cranial area of said user, said cranial support means having a front, a back, and two sides;

(b) front and back tension control means comprising a breast plate, a back plate, a first strap connecting right top portions of said breast plate and said back plate and adapted to fit over a right shoulder of said user, a second strap connecting left top portions of said breast plate and said back plate and adapted to fit over a left shoulder of said user, and a third strap connecting bottom portions of said breast plate and said back plate and adapted to fit about a waist of said user; and (c) at least four tensioning means connecting said cranial support means to said front and back tension control means, a first of said tensioning means connecting a front of said cranial support means to said breast plate, a second of said tensioning means connecting a back of said cranial support means to said back plate, and a third and a fourth of said tensioning means disposed equidistant from said second tensioning means on opposite sides thereof and connecting said cranial support means to said front and back tension control means.

10. The medical device of claim 9, wherein said tensioning means are elastic straps.

11. The medical device of claim 10, wherein said elastic straps are adjustable.

12. The medical device of claim 9, wherein said first of said tensioning means comprises a pair of spaced apart elastic straps connecting said cranial support means to said breast plate.

13. The medical device of claim 9, wherein said third of said tensioning means comprises a pair of elastic straps connecting said cranial support means to said front and back tension control means and said fourth of said tensioning means comprises a pair of elastic straps connecting said cranial support means to said front and back tension control means.

14. The medical device of claim 13, wherein said first of said tensioning means comprises a pair of spaced apart elastic straps connecting said cranial support means to said breast plate.

15. The medical device according to claim 9, further comprising a lumbar belt attached to said breast plate and said back plate.

16. The medical device of claim 9, wherein said cranial support means comprises an inflatable head band and said device further comprises means for inflating said inflatable head band.

17. A medical device for the isotonic treatment of the musculature of the cervical spine comprising:

(a) cranial support means adapted to removably engage a cranial area of a user, said cranial support means having a front, a back, and two sides;

(b) front and back tension control means functionally connected to said cranial support means by at least four tensioning means, a first of said tensioning means connecting said front of said cranial support means to said front tension control means, a second of said tensioning means connecting said back of said cranial support means to said back tension control means, and a third and a fourth of said tensioning means connecting said two sides of said cranial support means to said front and back tension control means;

(c) a lumbar belt adapted to adjustably fit around a user's waist;

(d) a plurality of positioning straps adjustably connecting said lumbar belt to said front and back tension control means, said positioning straps maintaining said front and back tension control means in relatively fixed position; and (e) a plurality of elastic straps connecting said lumbar belt to said front and back tension control means.

18. The medical device of claim 17, wherein said first of said tensioning means comprises a pair of spaced apart elastic straps connecting said cranial support means to said front tension control means.

19. The medical device of claim 18, wherein said pair of spaced apart elastic straps are adjustable.

20. The medical device according to claim 17, wherein said third of said tensioning means comprises a pair of elastic straps connecting said cranial support means to said front and back tension control means and said fourth of said tensioning means comprises a pair of elastic straps connecting said cranial support means to said front and back tension control means.

21. The medical device of claim 20, wherein said pair of elastic straps of said third of said tensioning means are adjustable and said pair of elastic straps of said fourth of said tensioning means are adjustable.

22. The medical device of claim 20, wherein said first of said tensioning means comprises a pair of spaced apart elastic straps connecting said cranial support means to said front tension control means.

23. The medical device of claim 22, wherein all of said elastic straps are adjustable.

24. The medical device of claim 17, wherein said cranial support means comprises a head band with a plurality of attachment means for said tensioning means.

25. The medical device of claim 24, wherein said head band is inflatable and said device further comprises means for inflating said inflatable head band.

26. The medical device of claim 17, wherein said front tension control means comprises a breast plate.

27. The medical device of claim 17, wherein said back tension control means comprises a back plate.

28. The medical device of claim 17, wherein said device further comprises a chin cup.

29. The medical device of claim 28, further comprising at least one elastic strap adapted to provide tensile loads between said chin cup and said cranial support means.

30. The medical device of claim 28, further comprising at least one elastic strap adapted to provide tensile loads between said chin cup and said front and back tension control means.

31. The medical device of claim 28, further comprising at least one elastic strap adapted to provide tensile loads between said chin cup and said lumbar belt.

32. The medical device of claim 17, wherein said positioning straps are inelastic.

* * * * *